US008727390B2

(12) United States Patent
Do

(10) Patent No.: US 8,727,390 B2
(45) Date of Patent: May 20, 2014

(54) SIDE-DRIVEN ACTION PIN LATCH

(75) Inventor: Thai Do, Laguna Niguel, CA (US)

(73) Assignee: Alcoa Inc., Pittsburgh, PA (US)

( * ) Notice: Subject to any disclaimer, the term of this patent is extended or adjusted under 35 U.S.C. 154(b) by 530 days.

(21) Appl. No.: 13/023,081

(22) Filed: Feb. 8, 2011

(65) Prior Publication Data

US 2011/0193351 A1 Aug. 11, 2011

Related U.S. Application Data

(60) Provisional application No. 61/337,615, filed on Feb. 9, 2010.

(51) Int. Cl.
*E05C 9/00* (2006.01)

(52) U.S. Cl.
USPC ..... 292/6; 292/159; 292/140; 292/57

(58) Field of Classification Search
USPC ..... 292/6, 4, 57–62, 140, 156–162
See application file for complete search history.

(56) References Cited

U.S. PATENT DOCUMENTS

| | | | | |
|---|---|---|---|---|
| 1,206,342 | A * | 11/1916 | Linborg | 292/6 |
| 2,726,889 | A * | 12/1955 | Lawson | 292/170 |
| 4,053,177 | A | 10/1977 | Stammreich | |
| RE31,935 | E | 7/1985 | Poe | |
| 4,828,299 | A | 5/1989 | Poe | |
| 5,341,752 | A * | 8/1994 | Hambleton | 109/59 R |
| 6,123,370 | A | 9/2000 | Rozema et al. | |
| 6,361,090 | B1 * | 3/2002 | Fan | 292/336.3 |
| 6,913,297 | B2 | 7/2005 | Johnson | |
| 8,479,543 | B2 * | 7/2013 | Yang et al. | 70/118 |
| 2005/0087996 | A1 | 4/2005 | Jackson et al. | |
| 2011/0109103 | A1 | 5/2011 | Huston et al. | |

FOREIGN PATENT DOCUMENTS

| | | | |
|---|---|---|---|
| DE | 202220 | C | 2/1908 |
| DE | 29807738 | U1 | 7/1998 |
| EP | 1091059 | A2 | 4/2001 |
| EP | 2031157 | A1 | 3/2009 |
| FR | 2397503 | E | 7/1977 |

(Continued)

OTHER PUBLICATIONS

International Search Report and Written Opinion in connection with International Patent Application No. PCT/US2012/059206 "Rotary-Handle Latch" dated Jan. 18, 2013 (9 pages).

(Continued)

*Primary Examiner* — Mark Williams
(74) *Attorney, Agent, or Firm* — Greenberg Traurig, LLP

(57) ABSTRACT

A pin latch including a mounting block having a longitudinal axis, a pin slidably retained within the mounting block and having a pivot-pin, and a sliding plate slidably retained within the mounting block, the plate having a slot and a longitudinal axis extending from first and second ends thereof and perpendicular to the longitudinal axis of the mounting block. The pivot-pin engages the slot of the plate such that movement of the sliding plate along its longitudinal axis induces movement of the pin in a direction of the longitudinal axis of the mounting block. A plurality of pin latches are connected in series by links in a side-by-side fashion or around corners. One link emanating from an actuator is connected to one of the plates that the actuator can actuate the pins of all the pin latches simultaneously.

14 Claims, 4 Drawing Sheets

(56) References Cited

FOREIGN PATENT DOCUMENTS

| | | | |
|---|---|---|---|
| FR | 2852049 | A1 | 4/2003 |
| GB | 191493 | A | 1/1923 |
| GB | 1497982 | A | 1/1978 |
| GB | 1537410 | A | 12/1978 |
| WO | 2010/033026 | A1 | 3/2010 |
| WO | 2010/149905 | E | 12/2010 |

OTHER PUBLICATIONS

International Search Report and Written Opinion for International Patent Application No. PCT/US2011/024031 entitled Side-Driven Action Pin Latch (11 pages).
International Search Report and Written Opinion in connection with International Patent Application No. PCT/US2012/066039 "Pin Latch With Detection Device and Movable Catch-Pin and Intermediate Position With Automatic Return Mechanism" dated Feb. 25, 2013 (15 pages).
International Search Report and Wiritten Opinion in connection with International Patent Application No. PCT/US2011/027671 Latch With Adjustable Handle (10 pages).
English language translation of WO 2010/149905 (8 pages).
International Search Report and Wiritten Opinion in connection with International Patent Application No. PCT/US2012/028418 "Pin Latch Having an Intermediate Position" (13 pages).
Fairchild Fasteners, Aerospace Mechanisms, "RAM" Aerospace Latch Mechanism, 2004 (4 pages).
Rotary Latch #TL18261 Alcoa Fastening Systems, Mar. 2005 (1 page).
Commonly owned U.S. Appl. No. 13/043,717 "Latch With Adjustable Handle". Filed Mar. 9, 2011 (18 pages).
Commonly owned U.S. Appl. No. 13/285,323. "Rotary Handle Latch", Filed Oct. 31, 2011 (31 pages).
Aerospace Latching Systems, Alcoa Fastening Systems, http://www.alcoa.com/fastening_systems/aerospace/en/product.asp?cat_id=213∏_id=500, pp. I1-2, I59-60, and i-iii (8 pages).

* cited by examiner

SIDE-DRIVEN ACTION PIN LATCH

CROSS-REFERENCE TO RELATED APPLICATION

This application is a Section 111(a) application relating to commonly owned, U.S. Provisional Application Ser. No. 61/337,615 entitled "SIDE-DRIVEN ACTION PIN LATCH SYSTEM," filed Feb. 9, 2010, the entirety of which is incorporated herein by reference.

FIELD OF THE INVENTION

The present invention relates to a pin latch, and, more particularly, to a side-driven action in latch.

BACKGROUND OF THE INVENTION

Access doors to spaces, such as airline passenger cabins, employ multiple pin latches. Multiple pin latches must secure these doors in their locked positions, especially under stressful environmental conditions. Because of the requirement to rapidly unlock the door, pins employed by the multiple pin latches must be simultaneously retracted from the door frame by a rotation of an external handle that is connected to a pin latch actuator centrally positioned within the door.

SUMMARY OF THE INVENTION

In an embodiment, a pin latch includes a mounting block having a base with a top surface and a bottom surface opposite the top surface, a front end and a rear end opposite the front end, and a first side and a second side opposite the first side, the mounting block having a longitudinal axis extending from the front end to the rear end of the base. In an embodiment, the pin latch includes a pin slidably retained within the mounting block, the pin including a first end positioned proximate to the front end of the base of the mounting block, a second end opposite the first end of the pin and positioned proximate to the rear end of the base of the mounting block, and a pivot-pin located proximate to the second end of the pin, wherein the pin extends in substantially the same direction as the longitudinal axis of the mounting block. In an embodiment, the pin latch includes a sliding plate slidably retained within the mounting block, the sliding plate including a first end, a second end opposite the first end of the sliding plate, and a slot, the sliding plate having a longitudinal axis extending from the first end of the sliding plate to the second end of the sliding plate, wherein the longitudinal axis of the sliding plate extends perpendicular to the longitudinal axis of the mounting block.

In an embodiment, the pivot-pin of the pin engages the slot of the plate, wherein movement of the sliding plate along its longitudinal axis induces movement of the pin in a direction of the longitudinal axis of the mounting block. In an embodiment, the pin is movable between a retracted position, in which the first end of the pin is retracted within the mounting block, and an extended position, in which the first end of the pin extends outwardly from the mounting block.

In an embodiment, a plurality of the pin latches are connected in series with each other by links (e.g., rods) in a side-by side fashion and/or in a daisy-chain fashion around corners. Because of the side-driven action of the pin latches, in an embodiment, the links interconnect adjacent plates of pin latches. In an embodiment, one link emanating from the pin latch actuator is connected to one of the plates so that the actuator may simultaneously actuate (i.e., retract or protract) the pins of all the pin latches simultaneously. In an embodiment, more than four pin latches may be actuated by the actuator simultaneously. In an embodiment, the actuator need not be located centrally among the pin latches.

BRIEF DESCRIPTION OF THE DRAWINGS

For a more complete understanding of the present invention, reference is made to the following detailed description of the exemplary embodiments considered in conjunction with the accompanying drawings, in which.

DETAILED DESCRIPTION OF THE DRAWINGS

Figure 1:
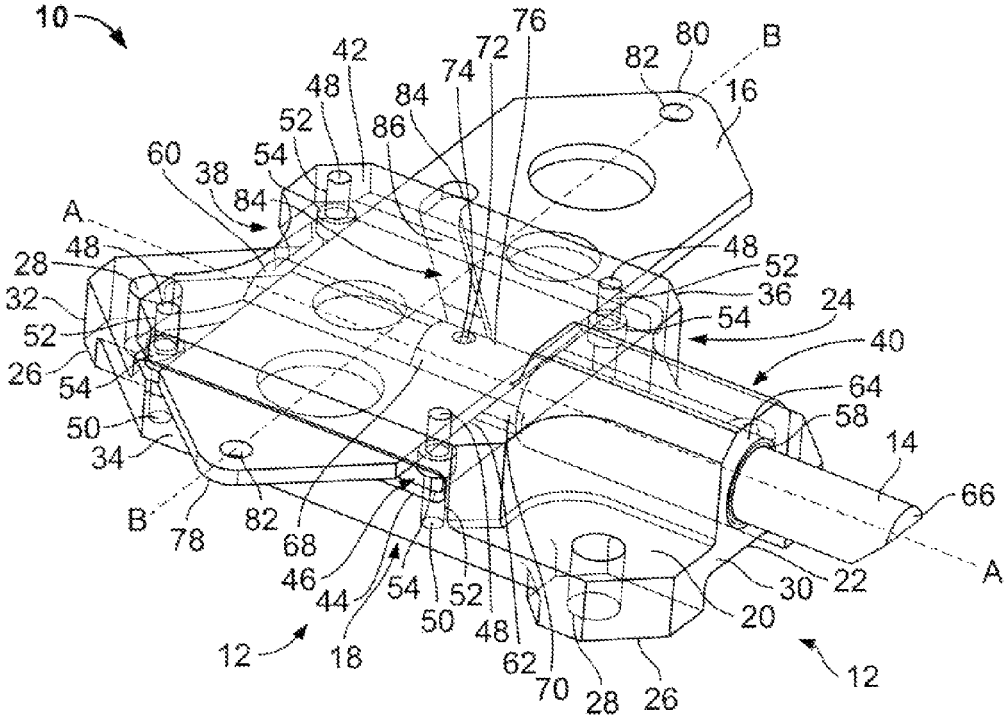
FIG. 1 is a top, front perspective view of a side-driven action pin latch constructed in accordance with an embodiment of the present invention, with a mounting block employed by the pin latch being transparently depicted for clarity.
Figure 2:
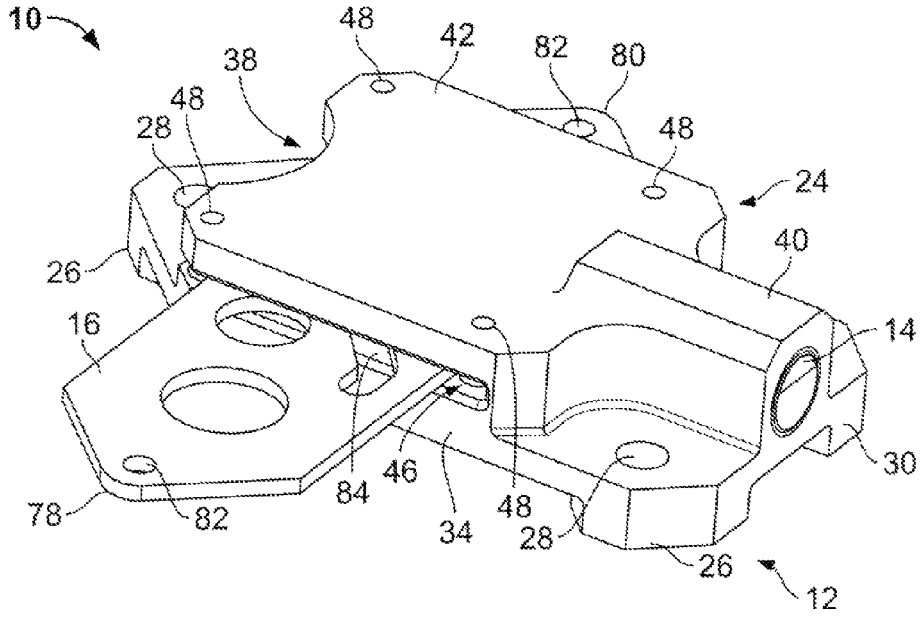
FIG. 2 is a top front perspective view of the pin latch shown in FIG. 1, which shows a plate employed by the pin latch extending from a first side of the mounting block, and a pin employed by the pin latch retracted within the mounting block.
Figure 3:
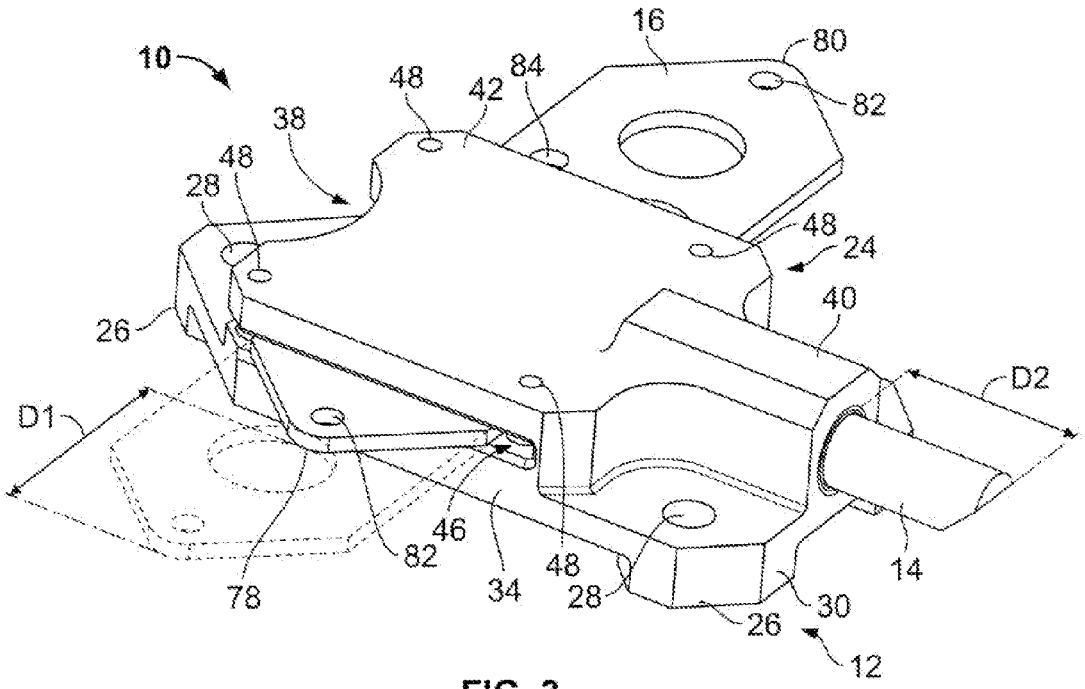
FIG. 3 is a top front perspective view of the pin latch shown in FIG. 1, which shows the plate extending from a second side of the mounting block and the pin protracted out of the mounting block.

FIGS. 1 through 3 illustrate a side-driven action pin latch 10 constructed in accordance with an embodiment of the present invention. In an embodiment, the pin latch 10 includes a mounting block 12, a pin 14 slidably retained within the mounting block 12, and a sliding plate 16 slidably retained within the mounting block 12. In an embodiment, the mounting block 12 includes a base 18 having top and bottom surfaces 20, 22. In an embodiment, a pedestal 24 projects outwardly from the top surface 20 of the base 18, and a plurality of feet 26 project outwardly from the bottom surface 22 of the base 18. In an embodiment, a hole 28 is positioned within each of the feet 26 for the purpose of confining a mounting-bolt or other suitable fastener (not shown in the Figures) for fastening the mounting block 12, for instance, to a door, an access panel, or any other suitable external surface or structure (not shown in the Figures). In an embodiment, the base 18 further includes front and rear ends 30, 32, respectively, and first and second sides 34, 36, respectively. In an embodiment, the mounting block 12 may be fabricated from aluminum, In other embodiments, the mounting block 12 may be fabricated from other suitable materials known in the art.

Still referring to FIGS. 1 through 3, in an embodiment, the pedestal 24 of the mounting block 12 includes a jaw 38 located proximate to the rear end 32 of the base 18 and a hub 40 located proximate to the front end 30 of the base 18. In an embodiment, the jaw 38 includes a planar cantilevered-plate 42 and a planar step 44 that is elevated above the top surface 20 of the base 18. In an embodiment, the plane of the cantilevered-plate 42 is parallel with the plane of the step 44, thereby forming a U-shaped mouth 46. In an embodiment, a portion of the mouth 46 adjacent to the rear end 32 of the base 18 is open, as are the sides of the mouth 46 adjacent to the first and second sides 34, 36 of the base 18, respectively. In an embodiment, an array of holes 48 is formed within the cantilevered-plate 42, with the axes of the holes 48 being oriented normally to the plane of the cantilevered-plate 42. In an embodiment, an array of holes 50 is formed within the step 44, with the axes of the holes 50 being oriented normally to the plane of the step 44. In an embodiment, each of the axes of the holes 48 of the cantilevered-plate 42 is coincident with a corresponding one of the axes of the holes 50 of the step 44 (i.e., each corresponding set of opposing holes 48, 50 are aligned with each other). In an embodiment, a pivot-pin 52 is fixedly fastened within each of the matching sets of aligned holes 48, 50. In some embodiments, the pivot-pins 52 are fastened within the holes 48, 50 by riveting, press fitting, gluing, welding, or other suitable means known in the art. In an embodiment, rollers 54 are positioned on the pivot-pins 52 and are sized and shaped to rotate freely about the pivot-pins 52 for purposes that are described hereinbelow. In an embodiment, the pivot-pins 52 and the rollers 54 are fabricated from stainless steel. In other embodiments, the pivot-pins 52 and the rollers 54 may be fabricated from other suitable materials known in the art.

Still referring to FIGS. 1 through 3, in an embodiment, the hub 40 includes a bore 58, which has a longitudinal axis A-A and is orientated in the same direction as a longitudinal axis of the mounting block 12. Semicircular concaved sections 60, 62 in the cantilevered-plate 42 and the step 44, respectively, have longitudinal axes that are coincident with the longitudinal axis A-A of the bore 58, and have sizes and shapes that are the same as corresponding semicircular sections of the bore 58. In an embodiment, a bushing 64 is fixedly fastened in the bore 58 of the hub 40 by press fitting or other suitable means known in the art (e.g., gluing or welding). In some embodiments, the bushing 64 may be fabricated from brass, bronze, or other suitable materials known in the art. In an embodiment, the pin latch 10 need not include the bushing 64.

With continued reference to FIGS. 1 through 3, in an embodiment, the mounting block 12 houses the pin 14 and the plate 16. In an embodiment, the pin 14 includes a first end 66 located proximate to the front end 30 of the base 18, and a second end 68 located proximate to the rear end 32 of the base 18. In an embodiment, the pin 14 is positioned within the bushing 64 of the bore 58 with its axis coincident with the axis A-A of the bore 58. In an embodiment, the pin 14 is sized and shaped to freely slide along the axis A-A within the bushing 64. In an embodiment, the bushing 64 diminishes metallic frictional wear that would otherwise occur if the pin 14 were permitted to slide directly within the bore 58 of the mounting block 12. In an embodiment, a groove 70 is formed axially within the pin 14 at the second end 68 thereof. In an embodiment, a pair of aligned holes 72 is transversely formed within the pin 14 and located proximate to the second end 68 of the pin 14. In an embodiment, a pivot-pin 74 is received within the holes 72. In an embodiment, the pivot-pin 74 is fastened within the holes 72 by riveting, press fitting, gluing, welding, or other suitable means known in the art. In an embodiment, a roller 76 is positioned on the pivot-pin 74, and is sized and shaped to fit within the groove 70 and rotate freely about the pivot-pin 74. In an embodiment, the pivot-pin 74, the plate 16, and the roller 76 are made of stainless steel. In other embodiments, the pivot-pin 74, the plate 16, and the roller 76 are made from other appropriate materials. In an embodiment, the aforesaid position, size and shape of the concaved semicircular sections 60, 62 of the cantilevered-plate 42 and step 44, respectively, avoids metallic contact between the pin 14 and the cantilevered-plate 42 and step 44 during motion of the pin 14 in direction of the longitudinal axis A-A of the bore 58.

With continued reference to FIGS. 1 through 3, in an embodiment, the plate 16 includes first and second ends 78, 80. In an embodiment, holes 82 are formed within the first and second ends 78, 80, respectively, of the plate 16 for facilitating the fastening of links thereto, which shall be described in more detail below (see FIGS. 5 and 6). In another embodiment, the holes 82 need not be included, and the first and second ends 78, 80 of the plate may include other attachment means for attachment to the links. In an embodiment, the plate 16 includes a slot 84 having a channel 86. In an embodiment, the channel 86 is obliquely oriented to the longitudinal axis B-B of the plate 16 as well as the longitudinal A-A axis of the bore 58 and, in turn, the longitudinal axis of the pin 14. In an embodiment, the groove 70 of the pin 14 is sized and shaped to receive a portion of the plate 16. In an embodiment, the thickness of the plate 16 is smaller than: (a) the height of the roller 76 of the pin 14, and (b) the width of the groove 70 of the pin 14, thereby permitting the roller 76 to be installed within the slot 84 of the plate 16. In an embodiment, a sliding motion of the plate 16 is facilitated by the rollers 54 positioned in the mouth 46 of the jaw 38 such that the plate 16 slides along the longitudinal axis B-B, which is perpendicularly oriented to the longitudinal axis A-A of the bore 58.

In an embodiment, because the roller 76 of the pin 14 is constrained to roll in the slot 84 of the plate 16, the sliding movement of the plate 16 in a direction along the longitudinal axis B-B produces movement of the roller 76 and the pin 14 in the direction of the longitudinal axis A-A of the bore 58. Referring specifically to FIG. 3, in an embodiment, a movement of the first end 78 of the plate 16 towards the first side 34 of the base 18 a distance D1 produces a movement of the pin 14 a distance D2 in the direction away from the front side 30 of the base 18, i.e., the pin 14 is protracted (i.e., extends) outside the bore 58 of the mounting block 12.

Figure 4:
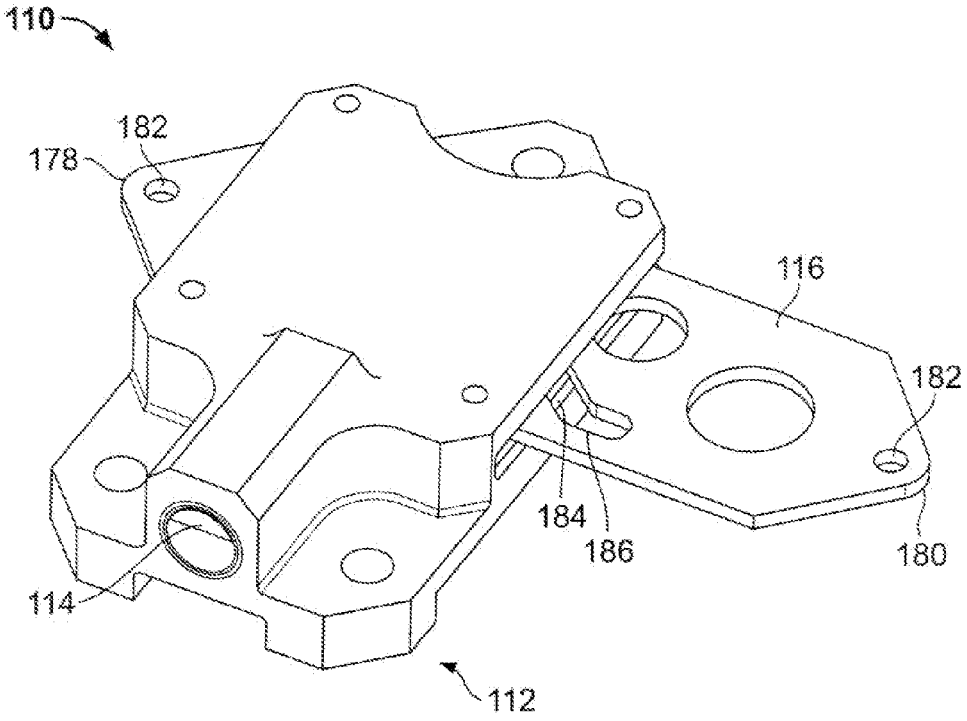
FIG. 4 is a top front perspective view of another embodiment of a side-driven action pin latch of the present invention.

FIG. 4 depicts another embodiment of the present invention. Elements illustrated in FIG. 4 which correspond, either identically or substantially, to the elements described above with respect to the embodiment shown in FIGS. 1 through 3 have been designated by corresponding reference numerals increased by one hundred, respectively. Unless otherwise stated, the embodiment shown in FIG. 4 is constructed and assembled in the same manner as the embodiment shown in FIGS. 1 through 3.

Referring to FIG. 4, in an embodiment, a side-driven action in latch 110 includes a mounting block 112 in which a pin 114 and a sliding plate 116 are slidably retained therein. In an embodiment, the plate 116 includes first and second ends 178, 180, and holes 182 formed within the first and second ends 178, 180, respectively, of the plate 116 for fastening links thereto, which will be described in more detail below (see FIGS. 5 and 6). In an embodiment, the plate 116 includes a slot 184 with a channel 186 which is obliquely oriented to a longitudinal axis of the plate 116. In an embodiment, a movement of the first end 178 of the plate 116 towards the mounting block 112 produces a movement of the pin 114 in the direction towards the mounting block 112, i.e., the pin 114 is retracted inside the mounting block 112.

Figure 5:
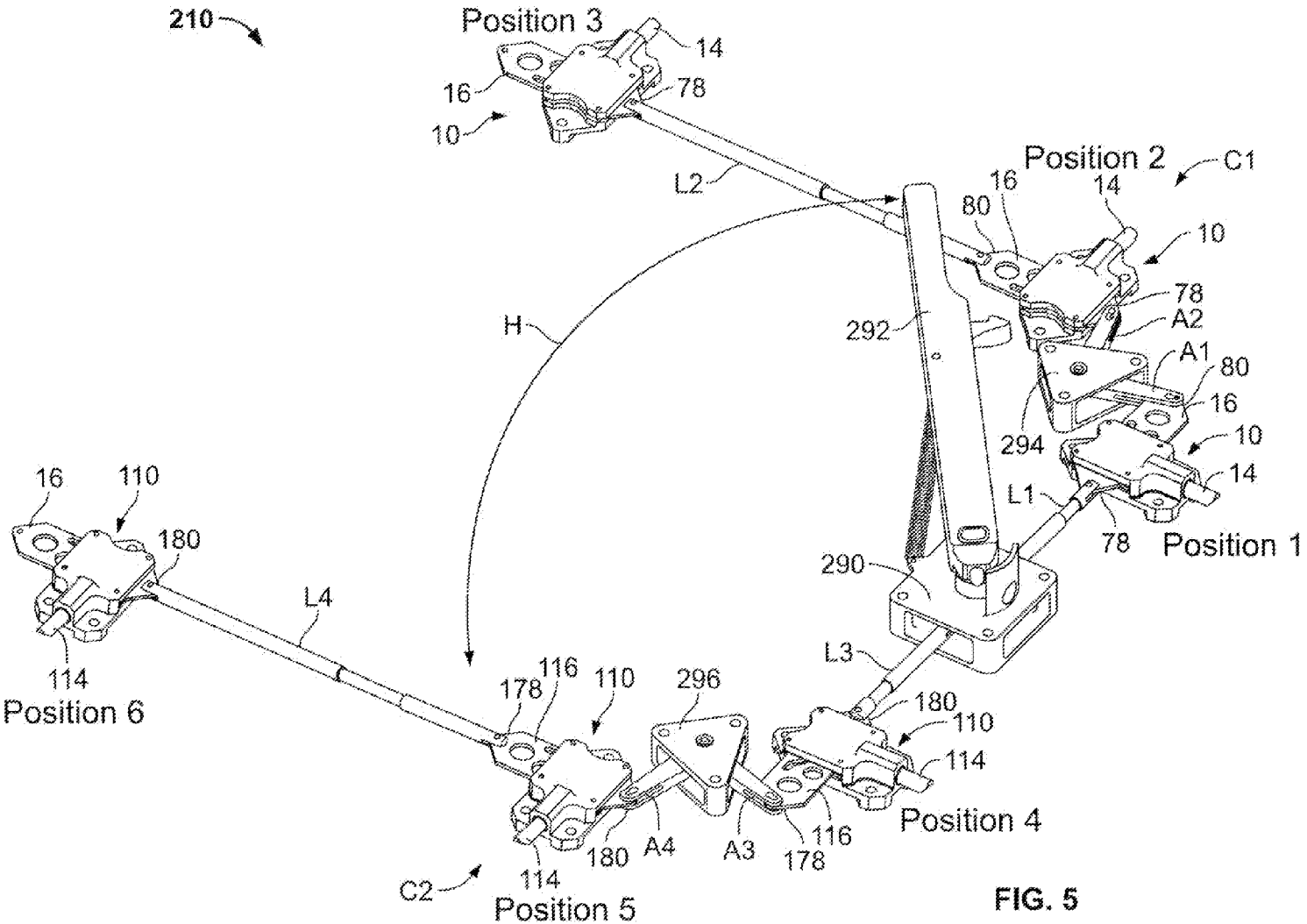
FIG. 5 is a top perspective view of a pin latch system including a pin latch actuator connected by links to chains of the pin latches shown in FIGS. 1 and 4, the pin latches being shown with their associated pins in protracted positions.

In an embodiment, FIG. 5 illustrates a pin latch system 210 which incorporates three of the pin latches 10 configured in a chain C1, and three of the pin latches 110 configured in a chain C2. All of the pins 14, 114 of the pin latches 10, 110, respectively, are shown in their protracted positions. In an embodiment, the system 210 includes a pin latch actuator 290 with opposing links L1, L3 extending therefrom, and a handle 292 attached thereto. In an embodiment, the chain C1 includes an array of three of the pin latches 10 located at Position 1, Position 2, and Position 3, and a bell crank 294 having movable arms A1, A2 located between Position 1 and Position 2. In an embodiment, the elements of the chain C1 are serially linked together in the following manner: (a) one end of the link L1 is pivotally connected to the first end 78 of the plate 16 of the pin latch 10 located at Position 1; (b) the second end 80 of the plate 16 of the pin latch 10 located at Position 1 is pivotally connected to one end of the arm A1 of the of the bell crank 294 located between Position 1 and Position 2; (c) one end of the arm A2 is pivotally connected to the first end 78 of the plate 16 of the pin latch 10 located at Position 2; and (d) one end of a link L2 is pivotally connected to the second end 80 of the plate 16 of the pin latch 10 located at Position 2 and an opposite end of the link L2 is pivotally connected to the first end 78 of the plate 16 of the pin latch 10 located at Position 3.

Figure 6:
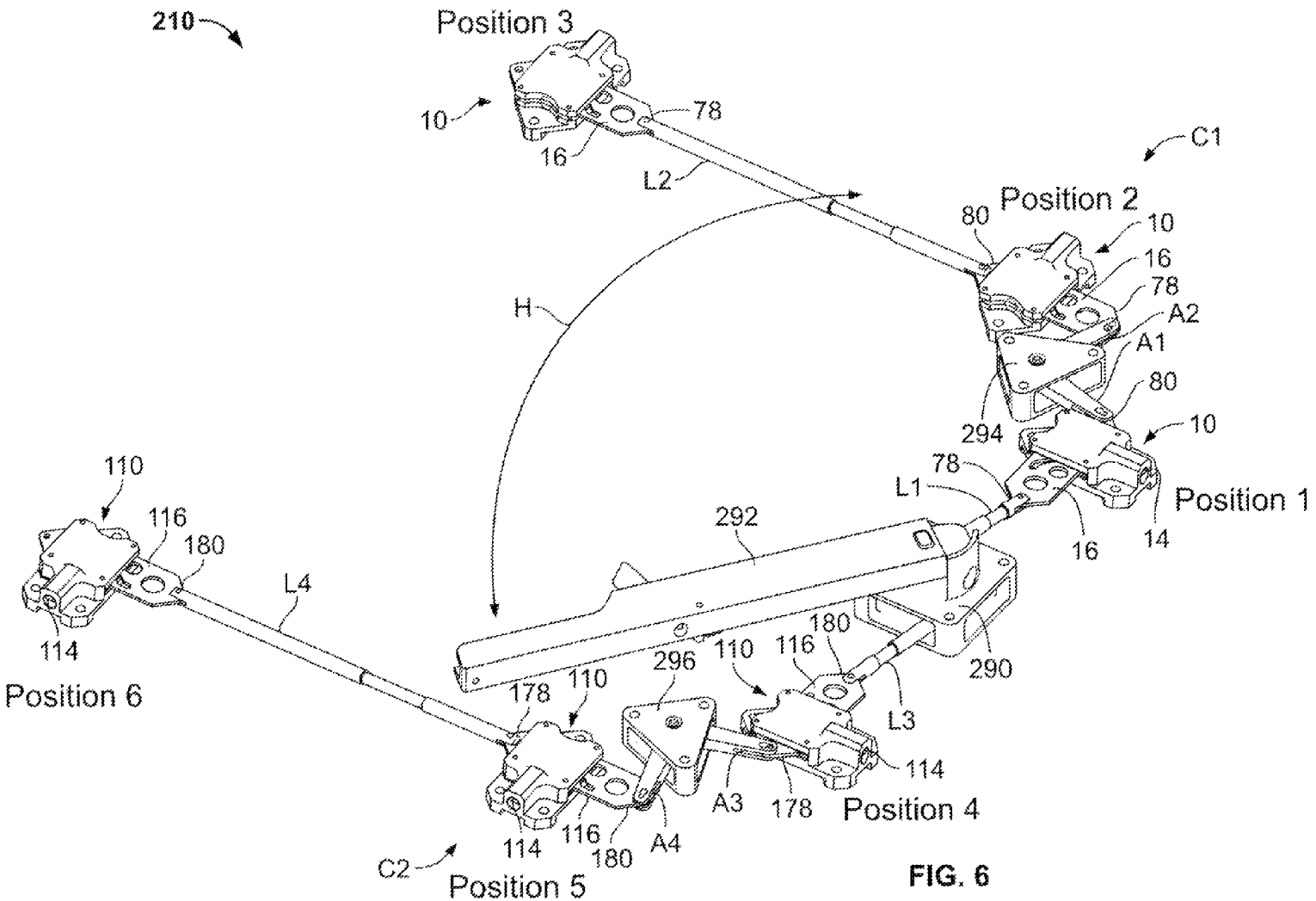
FIG. 6 is a top perspective view of the pin latch system shown in FIG. 5, the pin latches being shown with their associated pins in retracted positions.

In an embodiment, with continued reference to FIG. 6, the chain C2 includes an array of three of the pin latches 11 located at Position 4, Position 5, and Position 6, a bell crank 296 having movable arms A3, A4 located between Position 4 and Position 5. In an embodiment, the elements of the chain C2 are serially linked together in the following manner: (a) one end of the link L3 is pivotally connected to the second end 180 of the plate 116 of the pin latch 110 located at Position 4; (b) the first end 178 of the plate 116 of the pin latch 110 located at Position 4 is pivotally connected to one end of the arm A3 of the of the bell crank 296 located between Position 4 and Position 5; (c) one end of the arm A4 is pivotally connected to the second end 180 of the plate 116 of the pin latch 110 located at Position 5; and (d) one end of a link L4 is pivotally connected between the first end 178 of the plate 116 of the pin latch 110 located at Position 5 and an opposite end of the link L4 is pivotally connected to the second end 180 of the plate 116 of the pin latch 110 located at Position 6.

Referring to FIGS. 5 and 6, in an embodiment, when a user rotates the handle 292 from the position shown in FIG. 5, in the direction of the arrow H, to the position shown in FIG. 6, the pin latch actuator 290 retracts the links L1, L3. In an embodiment, the chains C1, C2 then transmit the movement of the links L1, L3 to side-driven action of the plates 16, 116 of the pin latches 10, 110, respectively. In an embodiment, the side-driven action of the plates 16, 116 then retracts all of the pins 14, 114 of the system 210 simultaneously.

In an embodiment, because of the side-driven action of the pin latches 10, 110, the adjacent plates 16, 116 of the pin latches 10, 110, respectively, can be arranged and interconnected in a serial or chain array. In this manner, in an embodiment, more than four of the pin latches 10 (and/or the pin latches 110) may be activated by the pin latch actuator 290 simultaneously. In addition, in an embodiment, the pin latch actuator 290 need not be located centrally in relationship to the pin latches 10, 110. In one or more other embodiments, four or less than four of the pin latches 10 (and/or the pin latches 110) can be utilized and activated in the system 210.

It should be noted that the present invention can have numerous modifications and variations. For instance, in an embodiment, the system 210 may have numerous other variations, combinations, numbers and/or configurations of the pin latches 10, 110, In an embodiment, the links L1-L4 may include turnbuckles to facilitate the positioning of the pin latches 10, 110 within the system 210. In addition, the bell cranks 294, 296 may be eliminated from the system 210 by the use of links L1-L4 that bend around corners (e.g., by using appropriately sized throttle-cable linkages). In an embodiment, the pin latches 10, 110 may be used for doors and access panels for aircraft, such as fuselages, nacelles, etc. In other embodiments, the pin latches 10, 110 can be used in other suitable environments and for other structures.

It will be understood that the embodiments described herein are merely exemplary and that a person skilled in the art may make many variations and modifications without departing from the spirit and scope of the invention. For instance, all such variations and modifications are intended to be included within the scope of the invention as defined in the appended claims.

What is claimed is:

1. A pin latch, comprising:

a mounting block including a base with a top surface and a bottom surface opposite the top surface, a front end and a rear end opposite the front end, and a first side and a second side opposite the first side, the mounting block further including a longitudinal axis extending from the front end of the base to the rear end of the base, and a pedestal projecting outwardly from the top surface of the base, the pedestal including a jaw located proximate to the rear end of the base, the jaw including a cantilevered-plate and a planar step elevated above the top surface of the base, the cantilevered-plate and the step forming a mouth;

a pin slidably retained within the mounting block, the pin including a first end positioned proximate to the front end of the base of the mounting block, a second end opposite the first end of the pin and positioned proximate to the rear end of the base of the mounting block, and a first pivot-pin located proximate to the second end of the pin, wherein the pin extends in substantially the same direction as the longitudinal axis of the mounting block; and a sliding plate slidably retained within the mounting block, the sliding plate including a first end, a second end opposite the first end of the sliding plate, and a slot, the sliding plate having a longitudinal axis extending from the first end of the sliding plate to the second end of the sliding plate, wherein the longitudinal axis of the sliding plate extends perpendicular to the longitudinal axis of the mounting block, wherein the mouth receives slidably the sliding plate, and wherein the first pivot-pin of the pin engages the slot of the sliding plate, wherein movement of the sliding plate along its longitudinal axis induces movement of the pin in a direction of the longitudinal axis of the mounting block, and wherein the pin is movable between a retracted position, in which the first end of the pin is retracted within the mounting block, and an extended position, in which the first end of the pin extends outwardly from the mounting block.

2. The pin latch of claim 1, wherein movement of the first end of the sliding plate towards the mounting block induces the pin to move towards its extended position.

3. The pin latch of claim 1, wherein movement of the first end of the sliding plate towards the mounting block induces the pin to move to its retracted position.

4. The pin latch of claim 1, wherein the slot of the sliding plate includes a channel that is oriented obliquely relative to the longitudinal axis of the mounting block and the longitudinal axis of the sliding plate.

5. The pin latch of claim 1, wherein the cantilevered-plate includes a first plurality of holes, and the step includes a second plurality of holes, each of the first plurality of holes of the cantilevered-plate is aligned with a corresponding one of the second plurality of holes of the step, and wherein each pair of the aligned first and second plurality of holes receives a corresponding one of a plurality of second pivot-pins.

6. The pin latch of claim 5, wherein each of the plurality of second pivot-pins includes a roller mounted thereon for facilitating movement of the sliding plate.

7. The pin latch of claim 6, wherein the pedestal includes a hub positioned proximate to the front end of the base of the mounting block, and wherein the hub includes a bore that is sized and shaped to slidably receive the pin.

8. The pin latch of claim 7, wherein the bore of the hub of the pedestal includes a longitudinal axis that is oriented in substantially the same direction as the longitudinal axis of the mounting block.

9. The pin latch of claim 8, wherein the hub includes a bushing positioned within the bore, and wherein the pin is slidably received within the bushing.

10. The pin latch of claim 8, wherein the pin includes a groove axially formed within the second end of the pin, and wherein the groove is sized and shaped to receive the sliding plate.

11. The pin latch of claim 10, wherein the pin includes a pair of aligned holes transversely formed therein proximate to the second end of the pin, and wherein the aligned holes of the pin are sized and shaped to receive the first pivot-pin of the pin.

12. The pin latch of claim 11, wherein the first pivot-pin of the pin includes a roller.

13. The pin latch of claim 12, wherein the mounting block includes a plurality of feet projecting from the bottom surface of the base, and wherein each of the plurality of feet includes a hole adapted to receive a fastener for mounting the pin latch to a structure.

14. The pin latch of claim 1, wherein each of the first and second ends of the sliding plate are adapted to connect to a link.

* * * * *